US006303015B1

(12) United States Patent
Thorpe et al.

(10) Patent No.: US 6,303,015 B1
(45) Date of Patent: Oct. 16, 2001

(54) AMORPHOUS METALLIC GLASS ELECTRODES FOR ELECTROCHEMICAL PROCESSES

(76) Inventors: Steven J. Thorpe, 184 College Street; Donald W. Kirk, 200 College Street, both of Toronto (CA), M5S 1A4

( * ) Notice: Subject to any disclaimer, the term of this patent is extended or adjusted under 35 U.S.C. 154(b) by 0 days.

(21) Appl. No.: 09/459,381

(22) Filed: Dec. 13, 1999

(51) Int. Cl.[7] ..... C22C 19/03; C25B 1/02

(52) U.S. Cl. ..... 205/630; 420/454; 420/441; 205/631; 205/632; 204/291

(58) Field of Search ..... 205/630, 631, 205/632; 420/441, 454; 204/291

(56) References Cited

U.S. PATENT DOCUMENTS

| | | | | |
|---|---|---|---|---|
| 4,150,981 | | 4/1979 | O'Handley . | |
| 4,770,949 | | 9/1988 | Hashimoto et al. . | |
| 5,429,725 | * | 7/1995 | Thorpe et al. ..... | 205/631 |

FOREIGN PATENT DOCUMENTS

| | | |
|---|---|---|
| 35 15 742 | 11/1986 | (DE) . |
| 0 016 916 | 10/1980 | (EP) . |
| 0 208 461 | 1/1987 | (EP) . |
| 0 314 805 | 5/1989 | (EP) . |
| 0 757 111 | 2/1997 | (EP) . |
| 02 061036 | 3/1990 | (JP) . |
| 04 362162 | 12/1992 | (JP) . |
| 05 070903 | 3/1993 | (JP) . |

OTHER PUBLICATIONS

Linker et al. ("Eletrolytic corrosion behavior of iron–, nickel– and cobalt base metallic glasses", Inst. of Physical Chemistry (German), pp. 391–397, 34(8), 1983, no month avail.).*

Lian et al. ("Hydrous oxide film growth on amorphous nickel–cobalt alloys", Journal of the Electrochemical Society, pp. 2877–2784, 138(10), 1991, no month available).*

* cited by examiner

*Primary Examiner*—Kathryn Gorgos
*Assistant Examiner*—Wesley A. Nicolas
(74) *Attorney, Agent, or Firm*—Manelli Denison & Selter; Edward J. Stemberger

(57) ABSTRACT

Metallic glass/amorphous metal electrodes produced by rapid solidification (i) having a structure that is either amorphous or nanocrystalline, (ii) containing tile principal alloying element as Ni, (iii) containing alloying additions of Co and at least one member of group IVB, VB, VIB VIIB and/or VIIIB, preferably Cr and V, in the range of 0 to 20 at. %, and when combined with Ni, represent 0.75 to 0.85 of the atomic fraction of the alloy, and (iv) containing metalloid elements comprised preferably of one or more of the elements C, B, Si and P either singly or in combination to represent 0.15 to 0.25 atomic faction of the alloy. The electrodes have excellent thermal stability, improved stability in an aqueous electrolyte and can provide improved current efficiency—anodic overpotential performance. They are used in the electrolysis of aqueous electrolyte solutions such as mixtures of caustic and water in the production of oxygen and hydrogen.

14 Claims, 4 Drawing Sheets

AMORPHOUS METALLIC GLASS ELECTRODES FOR ELECTROCHEMICAL PROCESSES

FIELD OF THE INVENTION

This invention relates to an improved electrode material for use in electrochemical processes and particularly an amorphous metal/metallic glass electrode material intended for constituting the active surface of an electrode for use in the electrolysis of aqueous solutions and more particularly in the electrochemical production of oxygen and hydrogen by said electrolysis.

BACKGROUND OF THE INVENTION

In electrolytic cells for the production of hydrogen and oxygen, such as those of the bipolar and unipolar type, an aqueous caustic solution is electrolyzed to produce oxygen at the anode and hydrogen at the cathode with the overall reaction being the decomposition of water to yield hydrogen and oxygen. The products of the electrolysis are maintained separate by use of a membrane/separator. Use of amorphous metals/metallic glasses and nanocrystalline materials, as electrocatalysts for the hydrogen and oxygen evolution reaction are known. The terms "amorphous metal" or "metallic glass" are well understood in the art and define a material which contains no long range structural order but can contain short range structure and chemical ordering. Henceforth, in this specification and claims both terms will be used as being synonymous and are interchangeable. The term "nanocrystalline" refers to a material that possesses a crystallite grain size of the order of a few nanometers; i.e. the crystalline components have a grain size of less than about 10 nanometers. Further, the term "metallic glass" embraces such nanocrystalline materials in this specification and claims.

In an electrolysis application, not all of the voltage that is passed through the cell during electrolysis is utilized in the production of hydrogen and oxygen. This loss of efficiency of the cell is often referred to as the cell overpotential required to allow the reaction to proceed at the desired rate and is in excess of the reversible thermodynamic decomposition voltage. This cell overpotential can arise from: (i) reactions occurring at either the cathode or the anode, (ii) a potential drop because of the solution ohmic drop between the two electrodes, or (iii) a potential drop due to the presence of a membrane/separator material placed between the anode and cathode. The latter two efficiencies are fixed by the nature of the cell design while (i) is directly a result of the activity of the electrode material employed in the cell including any activation or pre-treatment steps. Performance of an electrode is then directly related to the overpotential observed at both the anode and cathode through measurement of the Tafel slope and the exchange current density (hereinafter explained).

Superior electrode performance for the electrolysis of water may be achieved by the use of addition of metal salts to the electrolyte as "homogeneous" catalysts that function only in the liquid phase. These "homogeneous" catalysts suffer from the difficulty of having to add these additions to an operating cell to be functional, along with the toxicity of the metal salts in powder form and the disposal of electrolyte containing these additions. A desirable alternative would then be a base alloy comprised of Ni, and one or more of these metallic salt constituents which would still provide the same operating characteristics of a low voltage, high current cell behaviour corresponding to the evolution of hydrogen or oxygen while being electrochemically stable in the alkaline solution.

U.S. Pat. No. 5,429,725, issued Jul. 04, 1995 to Thorpe, S. J. and Kirk, D. W. describes the improved electrocatalytic behaviour of alloys made by combinations of the two elements Mo and Co in a Ni-base metallic glass.

However, this is still a need for higher exchange current densities combined with lower Tafel slopes in the (Cr, V)-containing alloys compared with the Mo-containing alloys and, accordingly, a need for enhanced operating efficiency of electrocatalyst material for alkaline water electrolysis

REFERENCE LIST

The present specification refers to the following publications, each of which is expressly incorporated herein by reference.

PUBLICATIONS

1. Lian, K. Kirk, D. W. and Thorpe, S. J., "Electrocatalytic Behaviour of Ni-base Amorphous Alloys", Electrochim. Acta, 36, p. 537–545, (1991)
2. Kreysa, G. and Hakansson, "Electrocatalysis by Amorphous Metals of Hydrogen and Oxygen Evolution in Alkaline Solution", J. Electroanal. Chem., 201, p. 61–83, (1986).
3. Podesta, J. J., Piatti, R. C. V., Arvia, A. J., Ekdunge, P., Juttner, K. and Kreysa, G., "The Behaviour of Ni—Co—P base Amorphous Alloys for Water Electrolysis in Strongly Alkaline Solutions Prepared through Electroless Deposition", Int. J. Hydrogen Energy, 17, p. 9–22, (1992).
4. Alemu, H. and Juttner, K., "Characterization of the Electrocatalytic Properties of Amorphous Metals for Oxygen and Hydrogen Evolution by Impedance Measurements", Electrochim. Acta., 33, p. 1101–1109, (1988).
5. Huot, J. -Y., Trudeau, M., Brossard, L. and Schultz, R. "Electrochemical and Electrocatalytic Behaviour of an Iron Base Amorphous Alloy in Alkaline Solution at 70° C.", J. Electrochem. Soc., 136, p. 2224–2230, (1989).
6. Vracar, Lj., and Conway, B. E., "Temperature Dependence of Electrocatalytic Behaviour of Some Glassy Transition Metal Alloys for Cathodic Hydrogen Evolution in Water Electrolysis", Int. J. Hydrogen Energy, 15, p. 701–713 (1990).
7. Wilde, B. E., Manohar, M., Chattoraj, I, Diegle, R. B. and Hays, A. K., "The Effect of Amorphous Nickel Phosphorous Alloy Layers on the Absorption of Hydrogen into Steel", Proc. Symp. Corrosion, Electrochemistry and Catalysis of Metallic Glasses, 88–1, Ed. R. B. Diegle and K. Hashimoto, Electrochemical Society, Pennington, p. 289–307 (1988).
8. Divisek, J., Schmitz, H. and Balej, "Ni and Mo Coatings as Hydrogen Cathodes", J. Appl. Electrochem., 19, p. 519–530, (1989).
9. Huot, J. -Y. and Brossard, L., "In-situ Activation of Nickel Cathodes by Sodium Molybdate during Alkaline Water Electrolysis at Constant Current", J. Appl. Electrochem., 20, p. 281, (1990).
10. Huot, J. -Y. and Brossard, "In-situ Activation of Nickel Cathodes during Alkaline Water Electrolysis by Dissolved Iron and Molybdenum Species", J. Appl. Electrochem., 21, p. 508, (1991).
11. Raj, I. A. and Vasu, K. I., "Transition Metal-based Hydrogen Electrodes in Alkaline Solution- Electrocatalysis on Nickel-based Binary Alloy Coatings", Int. J. Hydrogen Energy, 20, p. 32, (1990).
12. Jaksic, M. M., Johansen, B., and Ristic, M., "Electrocatalytic In-situ Activation of Noble Metals for Hydrogen Evolution" in *Hydrogen Energy Progress VIII*, T. N. Veziroglu and P. K. Takahashi, Eds., Pergamon Press, NY, p. 461, (1990).

SUMMARY OF THE INVENTION

It is an object of this invention to provide an improved electrode having an electrochemically active surface that can be used for the electrolysis of water.

It is a further object of this invention to provide an improved electrode that is chemically stable in an alkaline environment for both static and dynamic cycling operations of the cell.

It is a further object of the present invention to provide an improved electrode material that is sufficiently active so as to reduce either or both the anodic overpotential for oxygen evolution or the cathodic overpotential for hydrogen evolution.

It is a further object to provide an electrode that contains relatively inexpensive elemental constituents compared to the platinum group metals.

It is a further object to provide an electrode whose total processing operations necessary to final electrode fabrication are minimized in comparison to conventional electrode materials.

It is a further object to provide an electrode which can be operated at elevated temperatures in an alkaline environment to provide enhanced performance since the overpotential required to produce either hydrogen or oxygen is reduced as the operational temperature of the cell is increased.

Accordingly, the invention provides in one aspect a metallic glass of use in electrochemical processes, said metallic glass consisting essentially of a material of the general nominal composition $$(Ni,Co)_{100-x-t}\,A_x\,Z_t$$

wherein:

A is a member selected from the group consisting of IVb, Vb, VIb VIIb and VIII of the Periodic Table, Z is a member selected from the group consisting of carbon and a metalloid element selected from group IIIa, IVa, Va and VIa of the Periodic Table; and wherein x, t and (100-x-t) are atomic percents.

Preferably, A is at least one metal selected from the group consisting of Ti, V, Cr, Mn, Fe, Zr, Nb, Mo, Tc, Hg, Ta, and W; and wherein x is selected from about 1 to 20 atomic percent, more preferably x is selected from about 1–5 atomic percent.

Preferably, Z is at least one member selected from the group consisting of silicon, phosphorus, carbon, and boron; and wherein t is selected from about 15 to 25 atomic percent, more preferably t is about 20 atomic percent.

The metallic glass is most preferably in an elemental and homogenous state but some degree of non-homogeneity in both anionic and cationic form can be tolerated.

It will be understood that the general formula defined hereinabove represents a nominal composition and thus allows of some degree of variance from the exact atomic ratios shown.

Preferred materials according to the invention have the nominal compositions selected from $Ni_{50}Co_{25}Cr_5B_{20}Ni_{50}Co_{25}V_5B_{20}$ and $Ni_{45}Co_{25}Cr_5V_5B_{20}$.

The alloys of the present invention are readily made into self-supporting structures.

In a further aspect, the invention provides an electrode of use in an electrochemical cell comprising a metallic glass consisting of a material as hereinabove defined. The electrode may act as an anode, cathode or both as a working electrode. The materials of the invention may constitute a full electrode or a surface coating on a substrate such as a metal or other electrically conductive material.

In a yet further aspect, the invention provides an improved process for the electrochemical production of oxygen and hydrogen from an aqueous solution in an electrochemical cell, said process comprising electrolysing said aqueous solution with electrodes, said improvement comprising one or more of said electrodes comprising a metallic glass consisting essentially of a material as hereinabove defined.

In the electrolytic production of oxygen and hydrogen, the aqueous solution is alkaline.

Surprisingly, the metallic glasses according to the invention do not suffer from the loss of element "A" during use and retain electrolytic activity under severe conditions of use. Thus, we have found that the presence of element "A" in the alloys of the invention, while providing the unexpected advantages hereindescribed, surprisingly, does not result in dissolution of the element "A" under alkaline electrolysis conditions.

Thus, the invention provides a metallic glass/amorphous metal electrode material for electrochemical processes produced by rapid solidification (i) having a structure that is either amorphous or nanocrystalline, (ii) containing the principal alloying elements as Ni and Co, (iii) containing alloying additions such as Cr, V, Ti, Mn, Fe and the like in the range of 1 to 20 at. %, and when combined with Ni and Co, represent 0.75 to 0.85 of the atomic fraction of the alloy, and (iv) containing metalloid elements comprised preferably of one or more of the elements C, B, Si and P either singly or in combination to represent 0.15 to 0.25 atomic fraction of the alloy. The electrodes have excellent thermal stability, improved stability in an aqueous electrolyte and can provide improved current efficiency—anodic or cathodic overpotential performance. They are of use in the electrolysis of aqueous electrolyte solutions such as mixtures of caustic (KOH, NaOH) and water in the production of oxygen and hydrogen.

The electrodes are comprised of low cost transition metals in combination with metalloid elements in specific ratios to permit the alloy composition to be solidified into an amorphous state. They offer improved current efficiencies via anodic or cathodic overpotential performance and offer improved stability in both static and cyclic exposures. They can be used in concentrated alkaline solutions and at elevated temperatures for improved electrode performance. The electrodes are of use in the electrolysis of alkaline solutions resulting in the production of hydrogen and oxygen via the decomposition of water, and also additional uses in electrodes for fuel cells, electro-organic synthesis or environmental waste treatment.

Processing methodology of rapid solidification offers many cost advantages compared to the preparation of conventional Raney Ni type electrodes. The process is a single step process from liquid metal to finished catalyst, which can be fabricated in the form of ribbons or wires for weaving into a mesh grid. The process can also be used to produce sheets, powders, flakes, etc. which can further be consolidated into a desired shape or patterned. By comparison, conventional electrode fabrication involves the production of a billet or rod, wire drawing and annealing operations, weaving to form a wore mesh grid, surface treatment, powder deposition, powder consolidation Table 1 summarizes the results of prior art investigation involving transition metal-metalloid glasses. The performance of an electrocatalyst in Table 1 has been summarized in terms of two principle parameters: (i) the Tafel slope, $\beta_c$, and (ii) the logarithm of the exchange current density $i_o$. The exchange current density is equivalent to the reversible rate of a reaction at equilibrium at the standard half-cell or redox potential. The Tafel slope refers to the slope of the line representing the relation between overpotential and the rate of a reaction reflected as current density where there exists linearity on a semilogarithmic plot overpotential and current density.

TABLE 1.0

Polarization Data of Ni-Co base Amorphous Metals for HER in Alkaline Solutions

| Amorphous Electrode | Solution | Temperature | $-\log i_0$ (A/cm$^2$) | $\beta_c$ (mV/decade) | Reference |
|---|---|---|---|---|---|
| $Ni_{50}Co_{25}Si_{15}B_{10}$ | 1M KOH | 30 | 5.7 | 110,178 | 1 |
| | | 30 | 6.5 | 90 | 2 |
| | | 50 | 10.6 | 93 | 2 |
| | | 70 | 7.6 | 127 | 2 |
| | | 90 | 7.9 | 113 | 2 |
| Surface-treated | 1M KOH | 30 | 5.4 | 91,145 | 1 |
| $Ni_{50}Co_{25}Si_{15}B_{10}$ | 1M KOH | 30 | 5.8 | 101,144 | 1 |
| Surface-treated | 1M KOH | 30 | 5.4 | 111,166 | 1 |
| $Co_{50}Ni_{25}P_{15}B_{10}$ | 1M KOH | 30 | 5.4 | 124,174 | 1 |
| Surface-treated | 1M KOH | 30 | 5.1 | 110,173 | 1 |
| Thermally-treated | 1M KOH | 30 | 4.0 | 100 | 3 |
| and anodically | | 50 | 3.2 | 120 | 3 |
| oxidized | | | | | |
| $Ni_{5.5}Co_{90}P_{4.5}$ | | 70 | 2.8 | 120 | 3 |
| | | 90 | 2.2 | 100 | 3 |
| $Ni_{58}CO_{20}Si_{10}B_{12}$ | 1M KOH | 30 | 5.0 | 140 | 2 |
| | | 50 | 4.7 | 146 | 2 |
| | | 70 | 4.7 | 155 | 2 |
| | | 90 | 4.3 | 145 | 2 |
| $Co_{28}Ni_{10}Fe_5Si_{11}B_{16}$ | 1M KOH | 30 | 4.6 | 174 | 2 |
| | | 50 | 5.5 | 119 | 2 |
| | | 70 | 5.4 | 120 | 2 |
| | | 90 | 5.3 | 128 | 2 |
| $Ni_{70}Mo_{20}Si_5B_5$ | 1M KOH | 30 | 4.1 | 165 | 2 |
| | | 70 | 3.8 | 106 | 2 |
| | | 90 | 3.6 | 276 | 2 |
| $Fe_{39}Ni_{39}Mo_2Si_{12}B_8$ | 1M KOH | 30 | 5.0 | 123 | 2 |
| | | 50 | 4.8 | 150 | 2 |
| | | 70 | 4.9 | 173 | 2 |
| | | 90 | 4.9 | 167 | 2 |
| $Ni_{78}Si_8B_{14}$ | 1M KOH | 25 | 6.0 | 140 | 4 |
| | | 30 | 6.1 | 102 | 2 |
| | | 50 | 4.3 | 150 | 4 |
| | | 50 | 4.4 | 144 | 2 |
| | | 70 | 4.9 | 130 | 2 |
| | | 75 | 3.8 | 125 | 4 |
| | | 90 | 4.4 | 148 | 2 |
| Anodically oxidized | 30% KOH | 70 | 2.9 | 130 | 5 |
| $Fe_{40}Ni_{40}B_{20}$ | 1M KOH | 30 | 3.9 | 174 | 2 |
| | | 50 | 3.8 | 184 | 2 |
| | | 70 | 4.3 | 230 | 2 |
| | | 90 | 3.0 | 188 | 2 |
| $Ni_{66.5}Mo_{23.5}B_{10}$ | 0.5M NaOH | 25 | 5.6 | 120 | 6 |
| $Ni_{56.5}Mo_{23.5}Fe_{10}B_{10}$ | 0.5M NaOH | 25 | 5.3 | 100 | 6 |
| $Ni_{56.5}Mo_{23.5}Cr_{10}B_{10}$ | 0.5M NaOH | 25 | 5.0 | 135 | 6 |
| $Ni_{70}P_{20}C_{10}$ coating | 1N NaOH | 25 | 6.2–8.4 | 65 . 95 | 7 |
| $Ni_{75}Cr_5P_{20}$ | 1M HCl* | 30 | 3.5 | — | 8 |
| $Ni_{73}Cr_7P_{20}$ | 1M HCl* | 30 | 3.8 | — | 8 |
| $Ni_{70}Cr_{10}P_{20}$ | 1M HCl* | 30 | 4.0 | — | 8 |

*not for electrolysis in an alkaline media

TABLE 2

Polarization Data of Ni-Co base Amorphous Metals for HER in Alkaline Solution with Homogeneous Catalyst additions

| Substrate and Addition of Catalyst (ppm × $10^{-3}$) | Solution | Temperature | $-\log i_0$ (A/cm$^2$) | $\beta_c$ (mV/decade) | Reference |
|---|---|---|---|---|---|
| Substrate | | | | | |
| Co | 7.6M | 70 | 3.9 | 79 | 9 |
| Fe | KOH | | 3.9 | 80 | |
| Ni | | | 3.7 | 95 | |
| Pt | | | 4.2 | 75 | |
| Fe addition = 0.014 | | | | | |
| Substrate | | | | | |
| Co | 7.6M | 70 | 3.4 | 151 | 10 |
| Fe | KOH | | 3.1 | 154 | |
| Ni | | | 2.8 | 182 | |
| Pt | | | 3.1 | 163 | |
| Mo addition = 0.024 | | | | | |
| Fe addition = 0.024 | | | | | |
| Substrate mild steel | 6.0M | 80 | — | 112 | 11 |
| $NiSO_4$ addition = 80 | KOH | | | | |
| $Na_2MoO_4$ addition = 20 | | | | | |
| Substrate mild steel | 6.0M | 80 | — | 112 | 11 |
| $NiSO_4$ addition = 80 | KOH | | | | |
| $Na_2MoO_4$ addition = 20 | | | | | |
| Substrate mild steel | 6.0M | 80 | — | 25 | 11 |
| $NiSO_4$ addition = 80 | KOH | | | | |
| $Na_2WO_4$ addition = 20 | | | | | |
| Substrate mild steel | 6.0M | 80 | — | 50 | 11 |
| $NiSO_4$ addition = 80 | KOH | | | | |
| $ZnSo_4$ addition = 40 | | | | | |
| Substrate mild steel | 6.0M | 80 | — | 25 | 11 |
| $NiSO_4$ addition = 80 | KOH | | | | |
| $FeSO_4$ addition = 20 | | | | | |
| Substrate mild steel | 6.0M | 80 | — | 112 | 11 |
| $NiSO_4$ addition = 80 | KOH | | | | |
| $CoSO_4$ addition = 20 | | | | | |
| Substrate mild steel | 6.0M | 80 | — | 150 | 11 |
| $NiSO_4$ addition = 80 | KOH | | | | |
| $CrO_3$ addition = 20 | | | | | |
| Substrate Pt | 5.0M | 25 | — | 80 | 12 |
| Molybdate addition | KOH | | | | |

The electrodes described in Table 1 contain various combinations of the transition metals in combination with (Ni, Co) but none of them incorporate element "A" in addition as described above. The electrodes described in Table 2 derive activity from the presence of the dissolved salts of element "A" as described above when added to the solution phase of the electrolytic cell, but not when incorporated directly into the substrate material.

BRIEF DESCRIPTION OF THE DRAWINGS

In order that the invention may be better understood, preferred embodiments will now be described by way of example only, with reference to the accompanying drawings, wherein.

DETAILED DESCRIPTION OF THE PREFERRED EMBODIMENTS OF THE INVENTION

The general methods for the preparation and testing of the materials according to the invention followed those described in aforesaid U.S. Pat. No. 5,429,725.

Experimental

Electrode metallic glass materials were prepared as follows having the nominal composition:

EXAMPLE 1

This Example illustrates the preparation electrodes having a nominal composition:

$$Ni_{50}Co_{25}Cr_5B_{20}$$

A series of processing trials were performed to fabricate amorphous alloy ribbons by the melt-spinning technique. The process was divided into two steps. The first step was termed "pre-melting" where a powder mixture of pure materials, i.e., nickel, cobalt, chromium, and boron, was charged onto a water cooled copper hearth, and melted via the use of vacuum arc melting. The second step employed a boron nitride ceramic crucible, which enabled the pre-melted and crushed button to be remelted and superheated to a temperature higher than 1100° C. in the vacuum chamber. A stream of molten metal was then blown through a thin slit of the ceramic crucible on to the peripheral surface of a massive copper wheel rotating at a high speed. Rapid quenching took place on the cold surface of the wheel, and the solidified deposit was produced in the form of thin ribbons. A concise description of amorphous metal production is given in the following subsections.

Apparatus:

Melt-Spinner D-7400 Tüibingen, Edmund Bühler, Germany $3.3\times10^{-2}$ Pascal High Vacuum Chamber Induction Heater TOCCOTRON 2EG103. The Ohio Crankshaft Co., U.S.A Maximum output 10 kW, 450 kHz Pyrometer : Model ROS-SU, Capintec Institute Inc., U.S.A.

Figure 1:
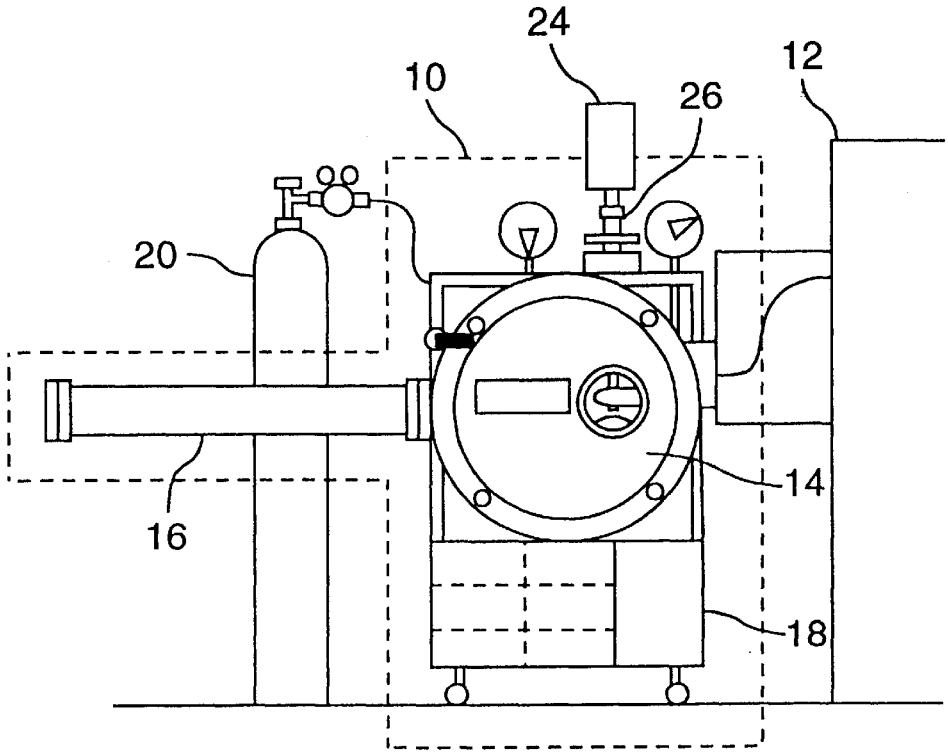
FIG. 1 is a schematic diagram of an apparatus for making a metallic glass according to the invention.

FIG. 1 illustrates the experimental apparatus consisting of a melt-spinner shown generally as 10 and an induction heating unit shown generally as 12. The melt-spinner assembly 10 comprised a high vacuum chamber 14, a ribbon collector tube 16, and a controller 18. The vacuum chamber 14 was connected to an argon cylinder 20 that supplied argon gas for purging the chamber 14 and pressurizing a ceramic crucible 22 (FIG. 2) in order to eject a molten mass of liquid material (not shown). The temperature of the molten mass of liquid in ceramic crucible 22 is measured by means of an optical pyrometer 24 attached to a quartz window 26 located above vacuum chamber 14.

Induction heater unit 12 was comprised of an induction heater coil 28 (FIG. 2) in vacuum chamber 14, a 3-stage step-up transformer and a closed-loop water recirculator (not shown) which supplied cooling water through the induction coil during heating.

Figure 2:
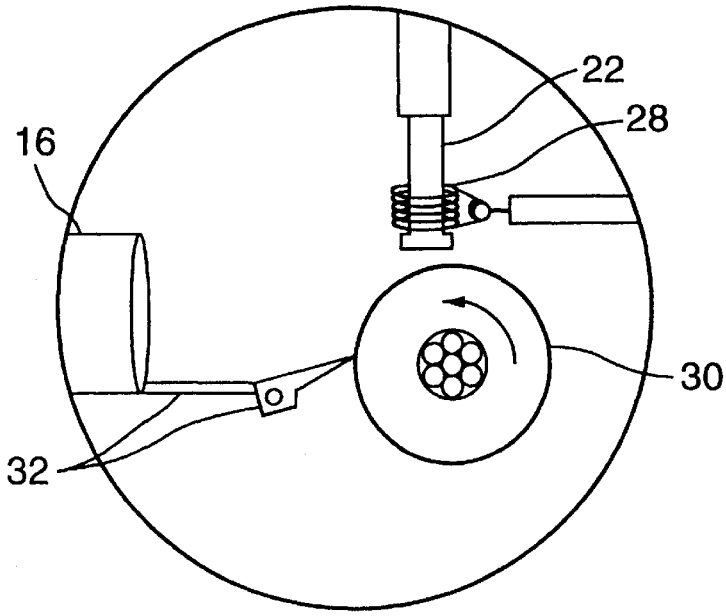
FIG. 2 is a schematic diagram detailing the interior of the vacuum chamber of the apparatus shown in FIG. 1.
Figure 3:
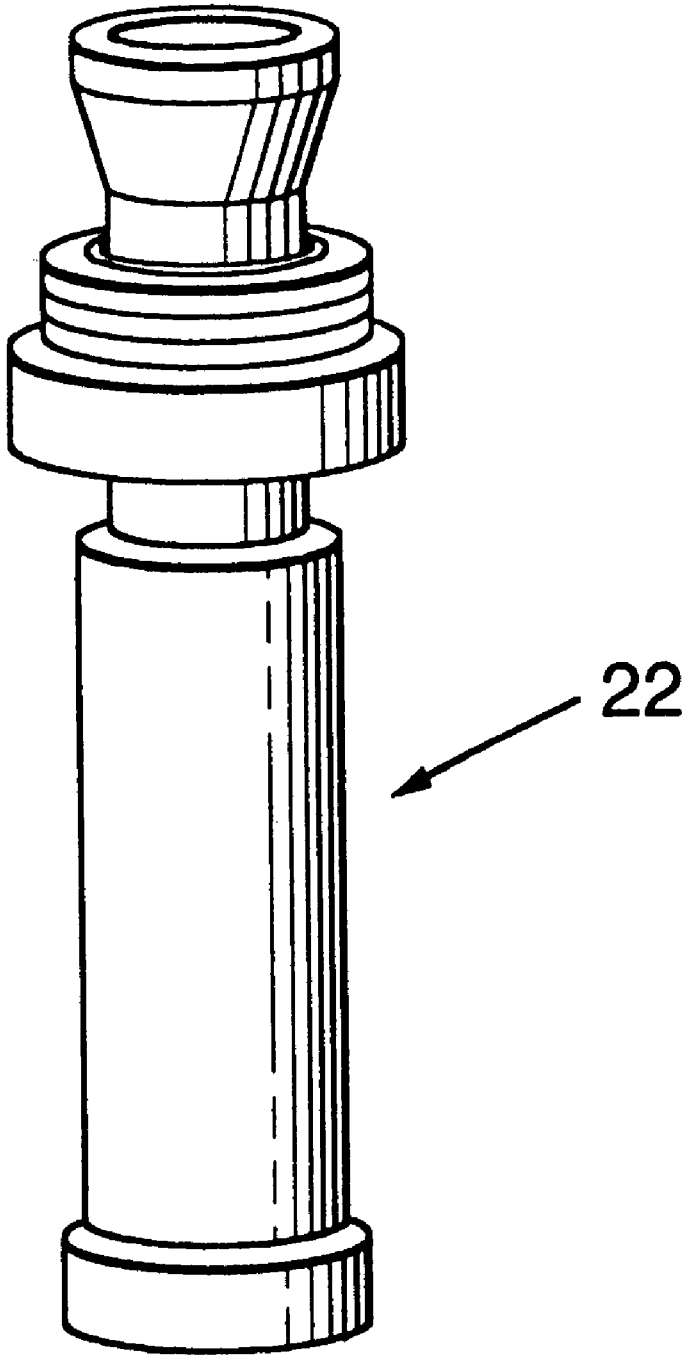
FIG. 3 is a perspective representation of a boron nitride ceramic crucible of use in the apparatus of FIG. 1.

FIG. 2 shows the arrangement of a copper wheel 30 (20 cm in diameter, 3.8 cm in width), ceramic crucible 22 induction coil 28 in high vacuum chamber 14 and ribbon guide 32.

A: Premelting

The targeted chemical compositions exemplified are collectively expressed as $Ni_{50}Co_{25}Cr_5B_{20}$. Because the compositional range of the alloy is relatively small, careful sample preparation was required to ensure an effective comparison in subsequent electrochemical measurements. In order to achieve the targeted compositions with high accuracy, pure material powders were utilized to fabricate pre-melted buttons first by vacuum arc melting followed by mechanical crushing and remelting using vacuum induction melting. In the exemplified powders each mixture contained 50 atomic % nickel, 25 atomic % Co and 20 atomic % of boron. The remaining 5 atomic % was made up with element A, in this example chromium. In an alternate embodiment of this invention, the boron was added in the form of an intermetallic compound like nickel boride which acted as a melting point depressant and enabled the whole powder mixture to start melting at a relatively low temperature, ca 1035° C.

A batch of 20–50 g of the powder mixture was charged into a quartz crucible (I.D.=19.05 mm, O.D.=22.2 mm, height=130 mm, with round bottom). The quartz crucible was mounted in the vacuum chamber of the melt-spinner and centered in the induction coil. The vacuum chamber was then purged three times with argon and evacuated to ca. 5×104 torr ($7\times10^{-2}$ Pa) before heating. The material powder mixture was melted at greater than 1100° C. in the quartz crucible. The weight loss ratio of materials through pre-melting was found to be<1 weight % for all constituents.

B: Melt Spinning

The melt spinner used in this work was an experimental sized model manufactured by Edmund Bühler GMBH capable of processing in batch mode 5–100 gram samples of alloy mixtures. The melt-spinner assembly comprised a high vacuum chamber, a ribbon collector tube, and a motor speed controller. The induction heater unit was comprised of an induction heater coil in the vacuum chamber, a 3-stage step-up transformer, and a closed-loop water recirculator, which supplied cooling water through the induction coil during heating. The vacuum chamber was connected to an argon cylinder that supplied gas for purging the chamber and pressurizing the ceramic crucible in order to eject a molten mass of liquid. The temperature of the molten mass of liquid in the ceramic crucible was measured by means of an optical pyrometer that was attached to a quartz window located above the vacuum chamber One or two pre-melted buttons were charged into the BN ceramic crucible. Boron nitride has the advantages of high hardness at elevated temperatures and good oxidation resistance that enabled the molten liquid to be superheated to over 1400° C. without any chemical reaction with the crucible.

The crucible was mounted above the Cu wheel in the vacuum chamber.

The chamber was purged and evacuated in the same manner as that described during premelting. The pre-melted button(s) was superheated in the crucible by the induction coil until the liquid temperature reached a stable maximum temperature, which was dependent on the alloy composition. The molten mass of liquid was ejected by argon pressure on to the wheel through a fine slit nozzle (0.5 ×15 mm). Planar amorphous ribbons were formed on the surface of the wheel rotating counterclockwise and driven along the ribbon guides to the collector tube. This particular form of melt spinning is referred to as the planar flow casting technique. From the wheel rotation speed, a quenching rate was estimated to be ca $10^{6°}$ C./sec. One side of the ribbon was free from contact with the wheel and had a shiny appearance (shiny side) compared with the dull appearance for the other side in contact with the wheel (wheel side). To minimize surface imperfections on the dull side due to contact with the wheel, the peripheral surface of the wheel was thoroughly polished with diamond paste and degreased with acetone before each run. Standard experimental parameters of the melt-spinning operation are summarized in Table 3.

TABLE 3

Summary of Operational Parameters of Melt-Spinning

| | |
|---|---|
| Clearance between the bottom most edge of the crucible and the wheel surface | 0.5 mm |
| Point of impingement | 12 degrees counterclockwise from the top of the wheel |
| Pre-melt button weight | 20–50 g |
| Vacuum chamber pressure | $7 \times 10^{-2}$ Pa or lower |
| Molten ejection pressure | 40 kPa |
| Wheel rotation speed | 1800–2900 rpm |
| Superheat temperature | higher than 1100° C. |

The alloys of the invention so produced by planar flow casting were submitted to the following further types of evaluation.

The first evaluation relates to the actual composition of the alloys produced as poor recoveries during melting can produce substantial deviations between the nominal and actual composition of a given alloy.

The second evaluation relates to the structure of the alloys produced as the processing method produces a metastable structure that is amorphous or nanocrystalline in nature.

The third evaluation relates to the electrode performance in relation to the overvoltage necessary for hydrogen production for as-melt spun ribbons under conditions related to the electrolysis of an alkaline solution.

The fourth evaluation refers to the examination of the surface of the electrode materials used under both constant potential and conditions of potential cycling as described above.

The first test was performed in order to obtain reliable information on the elemental composition of the amorphous alloys using inductively coupled plasma spectroscopy (ICP). Although only a very small weight loss, less than 1 weight %, was found during the premelting operation, if the loss was due to a single component, inaccuracies in the targeted compositions would result. Additionally, there was concern about any compositional fluctuation in the longitudinal direction of the amorphous ribbon. For this reason, two positions designated as center and tail were taken from each ribbon and analyzed. ICP is a technique that provides a quantitative analysis of almost all elements with a high level of detectability.

The technique requires that the sample to be analyzed be dissolved in an aqueous solution because the sample is introduced to the inductively coupled plasma in the form of an aerosol. Each amorphous ribbon was dissolved into concentrated nitric acid and diluted with water and hydrochloric acid to complete the designated matrix solution which contained 4 weight % $HNO_3$ and 4 weight % HCl. For experimental error analysis, some standard solutions were prepared with pure material powders. The major elements analyzed were Ni, Co, Cr, V, and B. Expected concentrations of Ni, Co, Cr, V, and B in the standard and sample solutions are summarized in Table 4.

TABLE 4

Summary of Expected Concentrations of ICP Samples (ppm)

| Serial No. | Solute | Ni | Co | Cr or V | B |
|---|---|---|---|---|---|
| #1 | Blank (1) | 0 | 0 | 0 | 0 |
| #2 | Standard (2) - metals | 10.00 | 10.00 | 10.00 | 0 |
| #3 | Standard (3) - metals | 100.00 | 100.00 | 100.00 | |
| #4 | $Ni_{54}Co_{25}Cr_1B_{20}$ center | 53.7 | 24.7 | 0.9 | 20.6 |
| #5 | $Ni_{54}Co_{25}Cr_1B_{20}$ tail | 54.0 | 24.8 | 1.0 | 20.1 |
| #6 | Standard | 54.0 | 25.0 | 1.0 | 20.0 |
| #7 | $Ni_{50}Co_{25}Cr_5B_{20}$ center | 50.6 | 24.6 | 5.0 | 19.9 |
| #8 | $Ni_{50}Co_{25}Cr_5B_{20}$ tail | 49.9 | 24.6 | 5.7 | 19.7 |
| #9 | Standard | 50.0 | 25.0 | 5.0 | 20.0 |
| #10 | $Ni_{35}Co_{25}Cr_{20}B_{20}$ center | 35.6 | 25.1 | 20.2 | 19.1 |
| #11 | $Ni_{35}Co_{25}Cr_{20}B_{20}$ tail | 35.7 | 25.1 | 20.2 | 18.9 |
| #12 | Standard | 35.0 | 25.0 | 20.0 | 20.0 |
| #13 | $Ni_{50}Co_{25}V_5B_{20}$ center | 50.8 | 25.3 | 4.6 | 19.3 |
| #14 | $Ni_{50}Co_{25}V_5B_{20}$ tail | 50.9 | 25.3 | 4.7 | 19.1 |
| #15 | Standard | 50.0 | 25.0 | 5.0 | 20.0 |
| #16 | Standard B1 | 0 | 0 | 0 | 10 |
| #17 | Standard B2 | 0 | 0 | 0 | 25 |
| #18 | Standard B3 | 0 | 0 | 0 | 50 |
| #19 | Standard B4 | 0 | 0 | 0 | 100 |

The second test was performed using the technique of X-ray diffraction in order to confirm the degree of crystallinity of the manufactured ribbons. For comparison, measurements were also carried out on crystallized fragments of the amorphous alloys as well as pure elemental nickel, cobalt, chromium, boron and the intermetallic nickel boride. The amorphous samples were prepared by cutting ribbons into 4 mm×10 mm rectangular pieces. The samples were then degreased with acetone, methanol and deionized water in sequence. The crystallized fragments had the same bulk composition as the corresponding amorphous alloy and were primarily in the form of brittle plate-like powder. To avoid preferential diffraction due to the plate-like surface of the fragments, the crystallized amorphous alloy was ground to form a fine powder in an agate mortar and dispersed on a slide glass before measurement. Diffraction patterns were measured on a Siemens D5000 X-ray diffractometer using 50 kV Cu—Kr□radiation with a Ni filter in the range of 20 to 70 degree-$2_\theta$ at a scan rate of 2 degree-$2_\theta$ per minute. The data was processed by Diffrac AT software.

The third test involved determining the electrochemical overpotential for hydrogen evolution by determination of the Tafel slope and exchange current density for the alloys produced above. Working electrodes were prepared from the Ni—Co—Cr—B amorphous alloy ribbons of ca. 20–50 $\mu$m thickness and 4 to 5 mm in width. The shiny side of the ribbon was ground, polished, and degreased. The as-polished ribbon was cut into approximately 10 mm×10 mm pieces, and each piece was joined to an insulated copper lead. The joined area, unpolished wheel side, and periphery of the polished side were thoroughly coated three times at 24 hr intervals by Amercoat 90® epoxy resin. This masking coat resists either alkaline or acidic environments. The exposed geometrical surface area of the fabricated electrodes was typically 0.03±0.01 cm $^2$.

Figure 4:
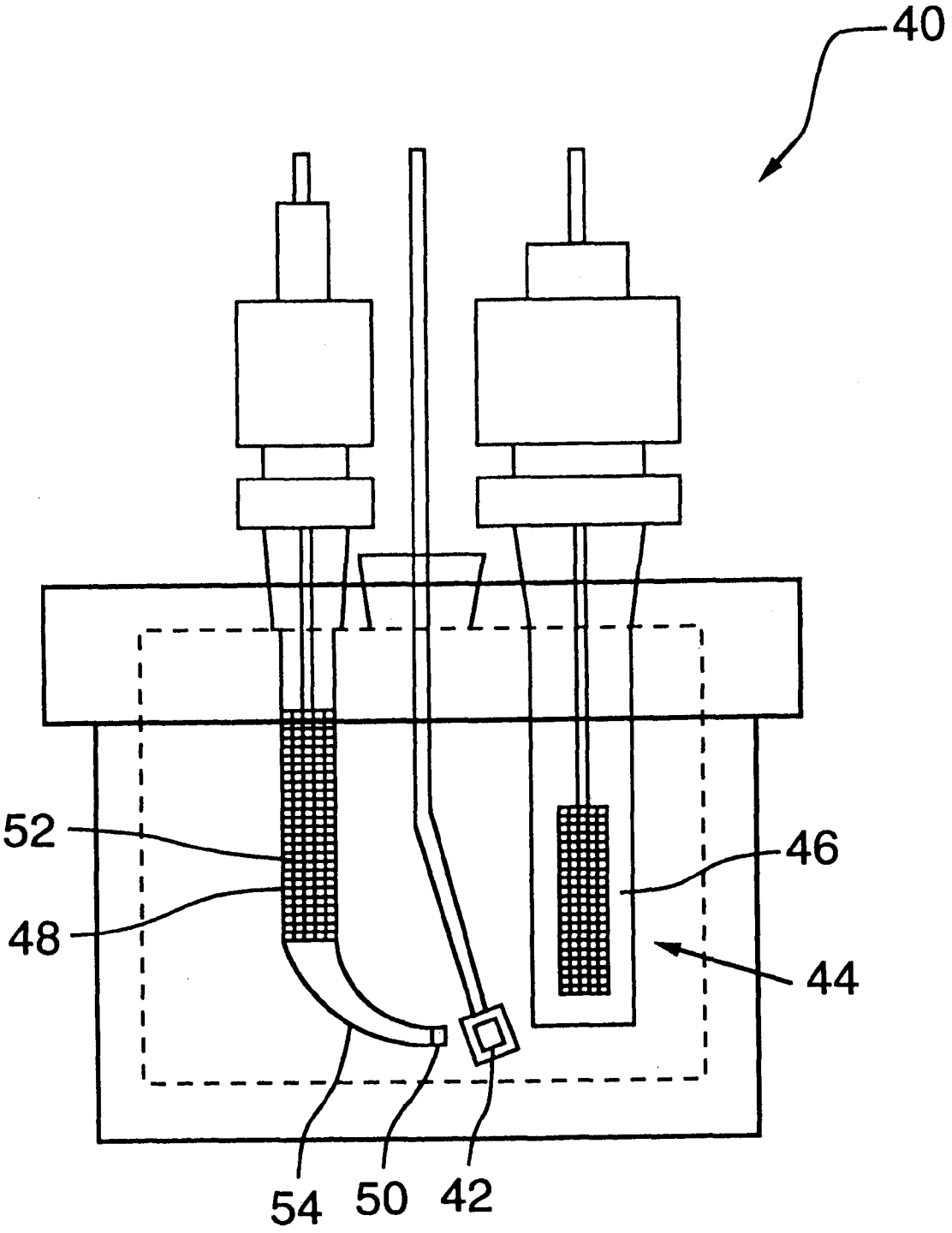
FIG. 4 is a schematic diagram of a three component cell used in the evaluation of the electrochemical activity and stability of the materials according to the invention.
Figure 5:
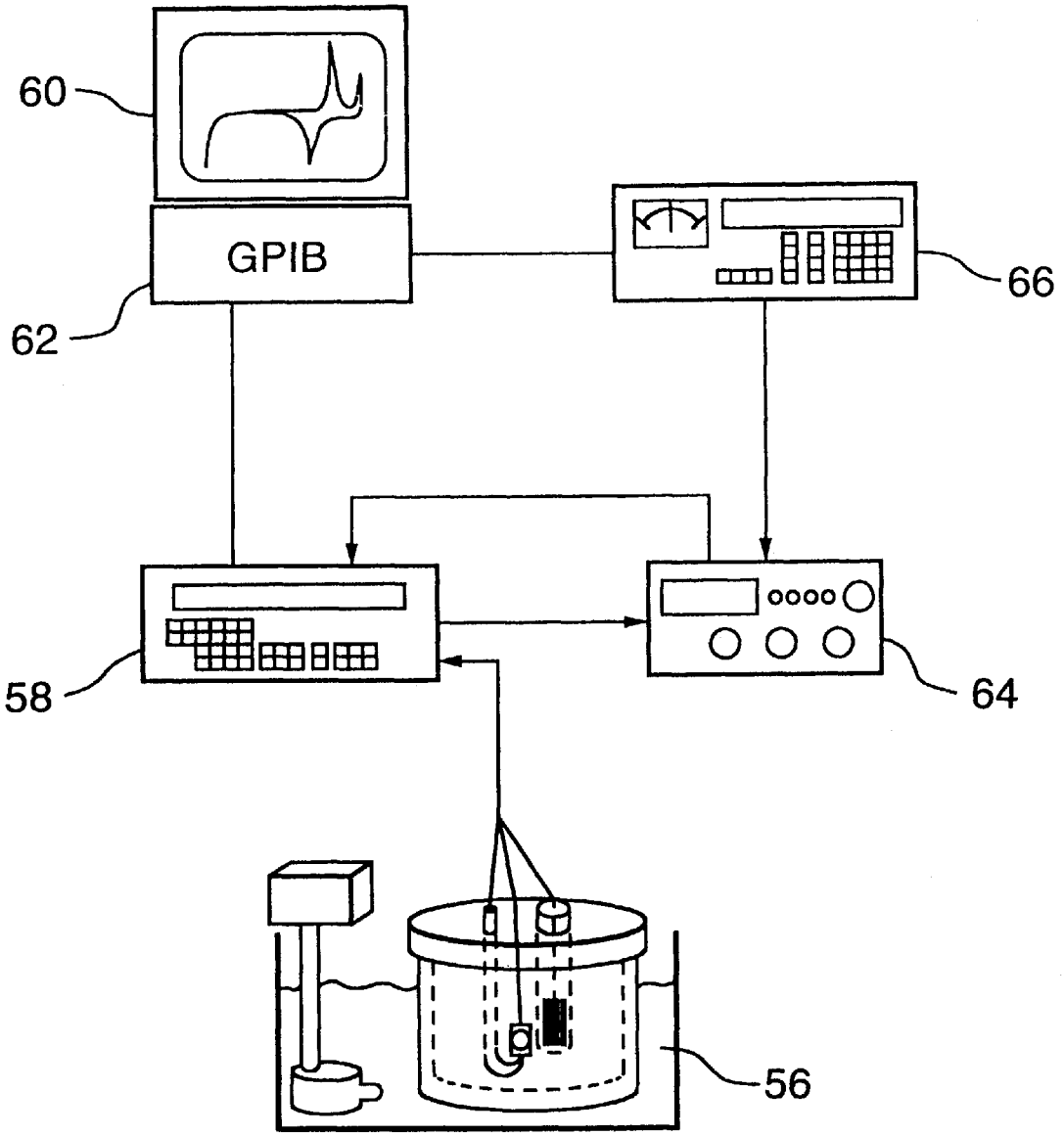
FIG. 5 is a diagrammatic representation of the apparatus of use in obtaining electrochemical measurements, and wherein the same numeral denotes like parts.

The electrolytic cell shown in FIG. 4 generally as 40 had a three-compartment structure consisting of a 300 ml capacity main body formed of Teflon® containing a working electrode 42 of the ribbon of alloy of the invention, a ½" Teflon® tube 44 housing a counter electrode 46, and a ¼" Teflon PTFE tube filled with mercury-mercuric oxide paste (Hg/HgO) 48. The compartments were separated by electrolyte-permeable membranes 50 in the form of a diaphragm or frit. The counter electrode 46 was a 25 mm×12.5 mm platinum gauze with a surface area of ca. 4.4 $cm^2$. The Hg/HgO paste in aqueous 1 M KOH solution was used as a reference electrode 52. The tip 54 of a Luggin capillary of the reference electrode compartment was placed a distance of ca. 2 mm to the working electrode surface of the alloys of the invention. All potentials quoted herein are referred to the Hg/HgO electrode in 1 M KOH solution at 30° C. The electrolyte was aqueous 8 M potassium hydroxide solution prepared with KOH and Type I water that had undergone pre-electrolysis for a minimum of 24 hours to remove any impurities in the KOH. The electrolyte was replaced with fresh electrolyte and was deaerated by argon at a rate of 30 ml/min prior to each experiment. Argon bubbling was continued during the experiment. The solution temperature was controlled at 70° C. in an 18 L, water bath 56 (FIG. 5) with an immersion heater (Polystat Immersion Circulator, Cole-Palmer).

The apparatus used for electrochemical measurements comprises water bath 56 in electrical contact with a potentiostat/galvanostat Hokuto Denko HA-501G with a 200 MHz Pentium II personal computer 60, through a GPIB interface 62 and arbitrary function generator (Hokuto Denko H-A-105B) 66.

The electrocatalytic activity of the amorphous alloys for the hydrogen evolution reaction (HER) was studied by a quasi-steady-state polarization technique. In practice, polarization curves of the amorphous electrodes were measured under quasi-potentiostatic conditions at a very low sweep rate of 2 mV/min. This potential sweep rate was found to be the maximum sweep rate that provided reproducible steady-state measurements. The as-polished working electrode was rinsed ultrasonically with acetone, methanol, and Type I water in sequence prior to testing. The electrode was then placed in the cell with deacrated 1M KOH solution and held at a potential of −1.3 V vs. Hg/HgO for 3 hours to clean the electrode surface electrochemically. The potential was swept over the range of −0.9 to −1.5 V vs. Hg/HgO for multiple cycles in order to assess the Tafel behaviour of the electrode response. Polarization curves were replicated at least three times for each electrode and analyzed for their reproducibility.

The fourth test was performed on amorphous alloy and crystalline surfaces to compare the degree of surface roughening and hence electrode degradation by using optical and scanning electron microscopy prior to and post use as an electrocatalyst in the cell. Optical investigation was achieved using a light stereoscope and light metallograph. Electron imaging was accomplished using a Hitachi S-570 SEM equipped with a Link Analytical 10/85s x-ray analyzer. Nominal imaging conditions were: accelerating voltage −20 kV, beam current −100 $\mu$A, sample tilt −15°.

In the first test a quantitative composition analysis by Inductively Coupled Plasma (ICP) Spectroscopy was performed. The average experimental composition of each amorphous ribbon as determined by the ICP analysis is listed in Table 5. All of the measured compositions of the amorphous ribbons were in good agreement with the targeted compositions. An average magnitude of the deviation of the actual from the nominal composition was<1 atomic %. Variations of principal element concentrations were also measured at two different longitudinal positions over the ribbon such as center and tail. There was no significant difference in the compositions at different positions. From these data, the amorphous ribbons can be regarded as homogeneous in the longitudinal direction.

TABLE 5

Composition of the Amorphous Ribbons (atomic percentage)

| Targeted Composition | Measured Composition |
|---|---|
| $Ni_{54}Co_{25}Cr_1B_{20}$ | $Ni_{53.7}Co_{24.8}Cr_{1.0}B_{20.1}$ |
| $Ni_{50}Co_{25}Cr_5B_{20}$ | $Ni_{49.9}Co_{24.6}Cr_{5.7}B_{19.7}$ |
| $Ni_{45}Co_{25}Cr_{10}B_{20}$ | $Ni_{45.1}Co_{24.9}Cr_{10.0}B_{20.0}$ |
| $Ni_{40}Co_{25}Cr_{15}B_{20}$ | $Ni_{40.3}Co_{25}Cr_{15.0}B_{19.7}$ |
| $Ni_{35}Co_{25}Cr_{20}B_{20}$ | $Ni_{35.7}Co_{25.1}Cr_{20.2}B_{18.9}$ |
| $Ni_{50}Co_{25}V_5B_{20}$ | $Ni_{50.9}Co_{25.3}V_{4.7}B_{19.1}$ |

In the second test, the structure of the ribbon was assessed using x-ray diffraction, as it is an integral part of the electrode performance independent of the exact composition of the electrode material. It is known that a typical X-ray diffraction (XRD) pattern of an amorphous material is a broad spectrum with no prominent sharp peaks relating to crystalline structure. Thus, qualitative confirmation of the amorphous nature of an alloy is demonstrated by a broad band peak in its XRD profile.

As additional information, an index, viz. effective crystallite dimension was calculated to evaluate the largest potential size of crystal embryos in the melt-spun ribbons.

The effective crystallite dimension is expressed by the equation:

$$D = \frac{0.91\lambda}{\beta\cos\theta}$$

where D is the effective crystallite dimension in nm and $\lambda$ is wavelength of the Cu-K□ radiation, i.e. 0.1542 nm. $\beta$ denotes the full width of a given diffraction peak in radians at half the maximum intensity. $\theta$ is the Bragg angle of the peak maximum. The effective crystallite dimension was measured for all the melt-spun ribbons. Results of the calculations are summarized in Table 6. The melt-spun Ni—Co—Cr—B alloys displayed very small values of the effective crystallite dimension determined from their broad band peak width in X-ray diffraction confirming the amorphous nature of the melt spun ribbons.

TABLE 6

Effective Crystallite Dimension

| Amorphous Alloy Composition | Peak Maximum Position 2θ (°) | Apparent Mean d-Spacing d (A) | Full Width of Half the Maximum Intensity β (rad) | Effective Crystallite Dimension D (nm) |
|---|---|---|---|---|
| $Ni_{35}Co_{25}Cr_{20}B_{20}$ | 45.1 | 1.993 | 0.138 | 1.1 |
| $Ni_{50}Co_{25}Cr_5B_{20}$ | 45.7 | 2.015 | 0.126 | 1.2 |
| $Ni_{51.4}Co_{25}Cr_{3.6}B_{20}$ | 46.3 | 2.015 | 0.136 | 1.1 |

In the third test, the electrocatalytic performance of the various amorphous electrodes was measured and compared to the behaviour of the crystalline elemental constituents. In the potential range of −0.9 to −1.5 V vs. Hg/HgO, the current responses (polarization curves) of crystalline Ni, Co, Cr, and the amorphous Ni—Co—(Cr,V)—B alloys varied from ca. 0.001 to 1000 mA/$cm^2$. A linear correlation was found in the potential vs. logarithimic current plot (Tafel plot) which were analyzed to obtain Tafel parameters, □$_c$ and $i_o$, by a statistical regression method. The Tafel slopes and exchange current densities are summarized in Table 7.

TABLE 7

Tafel Parameters of Electrodes for the HER in 1M KOH at 30° C.

| MATERIAL | TAFEL PARAMETERS | | |
|---|---|---|---|
| | −E* | $-\log i_0$** | $\square_c$*** |
| Crystalline | | | |
| Ni | 1.25–1.56 | 3.2 ± 0.3 | 239 ± 14 |
| Co | 1.25–1.44 | 4.0 ± 0.1 | 178 ± 4 |
| Mo | 1.20–1.40 | 6.6 ± 0.2 | 90 ± 4 |
| Amorphous | | | |
| $Ni_{50}Co_{25}Cr_5B_{20}$ | 1.01–1.50 | 3.15 | 161 |
| $Ni_{35}Co_{25}Cr_{20}B_{20}$ | 1.01–1.50 | 3.58 | 114 |
| $Ni_{50}Co_{25}V_5B_{20}$ | 1.00–1.50 | 3.96 | 100 |
| $Ni_{72}Mo_8B_{20}$ | 0.94–1.55 | 4.0 ± 0.04 | 180 ± 2 |
| $Ni_{72}Co_2Mo_6B_{20}$ | 1.00–1.50 | 5.1 ± 0.07 | 142 ± 3 |
| $Ni_{50}Co_4Mo_4B_{20}$ | 1.00–1.50 | 5.1 ± 0.03 | 148 ± 2 |

*Potential range (V vs. Hg/HgO),
**Exchange current density (A/cm$^2$),
*** Tafel slope (mV/decade), high field Appreciable differences in the current density values were clearly observed as a function of the compositions of the amorphous alloys as shown in Table 7. The following ranking of the electrocatalytic activity was found:

$$Ni_{50}Co_{25}V_5B_{20} > Ni_{35}Co_{25}Cr_{20}B_{20} > Ni_{50}Co_{25}Cr_5B_{20}$$

This ranking order does not simply follow the order of magnitude of the Cr/V content in the amorphous alloys, but is particular to the elemental form. The highest electrocatalytic activity of $Ni_{50}Co_{25}V_5B_{20}$ amongst the amorphous alloys could possibly be attributed to the synergetic effect of Ni—Co—V that may influence the nature of the oxide film formed on this amorphous alloy.

The improvement of this invention compared with U.S. Pat. No. 5,429,725 is also evident from Table 7 by comparison of the performance of the amorphous alloys. The invention shows higher exchange current densities combined with lower Tafel slopes in the (Cr,V)—containing alloys compared with the Mo-containing alloys; both features contribute to enhanced operating efficiency of the material as an electrocatalyst for alkaline water electrolysis.

In the fourth test, in order to obtain additional information on the condition of the electrode surface after multiple cycles of operation, specimens were examined using optical and scanning electron microscopy (SEM). It was found that the potential cycled crystalline Ni, Co and Mo electrodes had thick corrosion product layers. Crystalline Ni electrodes after 200 and 600 cycles showed a growth in the corrosion layer with potential cycling. The crystalline Co electrode showed a sign of crystallization/dissolution reactions by polygon-plate-like uniform deposits on the electrode surface. The crystalline Mo electrode showed a severely corroded surface and a remaining skeleton structure that indicated the active dissolution of Mo. All crystalline electrodes showed much higher roughness than their as-polished state.

In contrast, potential cycled amorphous electrodes showed very smooth surfaces and no indication of corrosion. Only a slight surface layer (probably Ni oxides) could be seen characterized by a dull transparent film that covered the very smooth surface of the amorphous alloys. No significant difference was found between the amorphous electrodes pre and post cycling. Hence, after exposure to severe potential cycling conditions, the amorphous alloy electrodes were more stable than the crystalline electrodes of the elements Ni, Co or Mo.

Although this disclosure had described and illustrated certain preferred embodiments of the invention, it is to be understood that the invention is not restricted to these particular embodiments. Rather, the invention includes all embodiments that are functional or mechanical equivalents of the specific embodiment and features that have been described and illustrated.

We claim:

1. A metallic glass of use in electrochemical processes, said metallic glass consisting essentially of a homogeneous material of the general nominal composition $$(Ni,Co)_{100-x-t}A_x\,Z_t$$

wherein:

Ni and Co are always present;

A is at least one member selected from the group consisting of IVb, Vb, VIb VIIb and VIII of the Periodic Table; provided that at least one of Cr and V is present and that A cannot be Fe or Mo;

Z is at least one member selected from the group consisting of carbon and a metalloid element selected from group IIIa, IVa, Va and VIa of the Periodic Table; wherein x is selected from about 1 to 20 atomic percent; t is selected from about 15 to 25 atomic percent; and 100-x-t is selected from about 55–84 atomic percent.

2. A metallic glass as claimed in claim 1 wherein A is at least one metal selected from the group consisting of Ti, V, Cr, Mn, Zr, Nb, Tc, Ta, and W.

3. A metallic glass as claimed in claim 2 wherein x is selected from about 1 to 5 atomic percent.

4. A metallic glass as claimed in claim 1 wherein Z is at least one member selected from the group consisting of silicon, phosphorus, carbon, and boron.

5. A metallic glass as claimed in claim 4 where in t is about 20 atomic percent.

6. A metallic glass as claimed in claim 1 wherein said Ni, Co, A and Z are in a substantially elemental state.

7. A metallic glass as claimed in claim 1 consisting essentially of a material having the nominal composition of $Ni_{50}Co_{25}Cr_5B_{20}$.

8. A metallic glass as claimed in claim 1 consisting essentially of a material having the nominal composition of $Ni_{50}Co_{25}V_5B_{20}$.

9. A metallic glass as claimed in claim 1 consisting essentially of a material having the preferred nominal composition of $Ni_{45}Co_{25}V_5Cr_5B_{20}$.

10. An electrode for use in an electrochemical cell comprising a metallic glass consisting essentially of a material as claimed in claim 1.

11. An electrode as claimed in claim 10 comprising a support and on at least a portion of said support a coating comprising said metallic glass.

12. An electrode as claimed in claim 10 in the form of a self-supporting structure.

13. An electrode as claimed in claim 10 wherein said electrochemical cell is for the electrochemical production of oxygen and hydrogen from an aqueous solution.

14. An improved process for the electrochemical production of oxygen and hydrogen from an aqueous solution in an electrochemical cell, said process comprising electrolysing said aqueous solution with electrodes, said improvement comprising one or more of said electrodes comprising a metallic glass consisting essentially of a material as claimed in claim 1.

* * * * *